US005740928A

United States Patent [19]

Dale et al.

[11] Patent Number: 5,740,928

[45] Date of Patent: Apr. 21, 1998

[54] CASK STAND

[76] Inventors: Ian Frank Dale; Margaret May Dale, both of 10 Sistertree Creek Road, Kin Kin, Queensland 4571, Australia

[21] Appl. No.: 663,064

[22] PCT Filed: Dec. 16, 1994

[86] PCT No.: PCT/AU94/00776

§ 371 Date: Jun. 13, 1996

§ 102(e) Date: Jun. 13, 1996

[87] PCT Pub. No.: WO95/17841

PCT Pub. Date: Jul. 6, 1995

[30] Foreign Application Priority Data

Dec. 24, 1993 [AU] Australia ..... PM3181

[51] Int. Cl.[6] ..... A47G 29/00

[52] U.S. Cl. ..... 211/71.01; 248/153; 211/181; D6/462

[58] Field of Search ..... 211/71, 181; 248/153, 248/175; D6/462; D7/701, 704

[56] References Cited

U.S. PATENT DOCUMENTS

| | | | |
|---|---|---|---|
| D. 151,126 | 9/1948 | Hilenski | 248/175 X |
| 619,362 | 2/1899 | Stevenson | 248/175 |
| 2,925,235 | 2/1960 | Jaros | 248/153 |
| 2,940,599 | 6/1960 | Gentner | D6/462 X |
| 3,214,031 | 10/1965 | McCauley | D7/704 X |
| 3,870,156 | 3/1975 | O'Neill | 211/74 |
| 4,046,260 | 9/1977 | Tallon | 248/175 X |
| 4,589,556 | 5/1986 | Peretz | 211/71 X |
| 4,699,342 | 10/1987 | Bartz et al. | 248/150 |
| 4,730,799 | 3/1988 | Foss et al. | 211/70.6 X |
| 4,903,923 | 2/1990 | Krentel | 248/153 |
| 4,971,277 | 11/1990 | Tedham et al. | 248/153 X |
| 5,002,246 | 3/1991 | Chaffin et al. | 248/153 |

FOREIGN PATENT DOCUMENTS

| | | |
|---|---|---|
| 84 899/82 | 11/1983 | Australia . |
| 821284 | 10/1959 | United Kingdom . |
| 2 185 679 | 7/1987 | United Kingdom . |
| 2 206 040 | 12/1988 | United Kingdom . |

*Primary Examiner*—Ramon O. Ramirez
*Assistant Examiner*—Kimberly T. Wood
*Attorney, Agent, or Firm*—Panitch Schwarze Jacobs & Nadel, P.C.

[57] ABSTRACT

A stand for wine casks having a rectangular block shape and a lower outlet tap. The stand consists of a platform which is elevated above a support surface, and side walls for preventing movement of the cask. A glass support means is removably fitted to the stand.

6 Claims, 1 Drawing Sheet

CASK STAND

BACKGROUND OF THE INVENTION

THIS INVENTION relates to stands for bench top containers which are used for storing and dispensing drinks. The invention is particularly concerned with cask containers which are widely used for wine and fruit juices. Such casks comprise a rectangular block shaped cardboard container having a plastic bag liner and an outlet tap protruding through the bottom of a side wall. In use, it is necessary to line the cask up on the edge of a support surface, such as a shelf or table top, before it can be emptied as sufficient space must be provided under the tap on the cask for the receptacle into which the contents are to be poured.

The placement of the cask on the edge of a support surface gives rise to a restriction in the mode of use as well as the potential for the cask to be pushed over the edge when the contents are being dispensed, particularly as the cask becomes empty and lightweight. In order to address the former of these problems, one previous solution was to place the cask on a block support, such as on top of another cask lying on its side, or on a box, brick or the like. None of these solutions are particularly practical or aesthetic but, more importantly, they do not address the latter of the aforementioned problems in that they do not give any side support to the cask, with the result that the cask is unstable and is prone to toppling over.

OBJECT OF THE INVENTION

It is therefore an object of the present invention to provide a means for supporting a cask to enable the contents to be readily dispensed without the aforementioned problems.

SUMMARY OF THE INVENTION

According to the present invention there is provided a stand for a rectangular block shaped cask having an outlet tap in a lower region, said stand comprising a platform and elevating means for retaining the cask above a support surface by a sufficient amount to enable a receptacle to be placed under the outlet tap, and associated restraining means to prevent lateral movement of the cask during manipulation of the outlet tap.

DETAILED DESCRIPTION OF THE INVENTION

Figure 1:
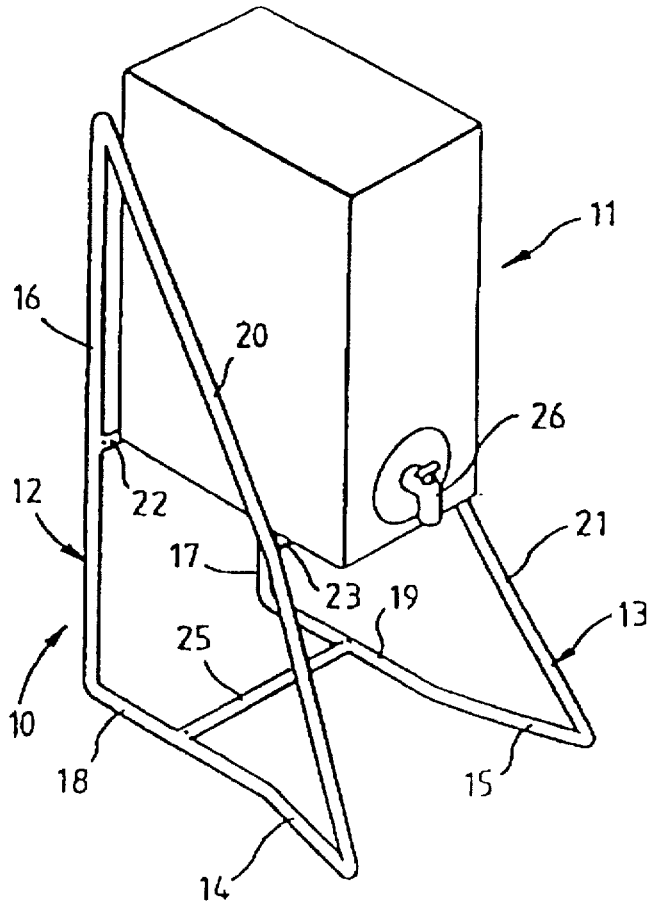

The stand is suitably dimensioned in most instances to support a cask at least about 120 mm above the support surface. That is, the distance from the base of the cask to the top of the support surface is at least about 120 mm. Preferably, the distance will be within the range of 120 to 200 mm for wine casks, most preferably about 140 mm for two litre casks and about 140 mm for four litre casks. The exact height selected will generally be determined according to the size of the cask but also having reference to the nature of the contents of the cask. Thus, for casks containing fruit juices, a height closer to 200 mm will often be more suitable as the contents may need to be poured into taller glasses than would the case be for wine or port.

The stand can comprise an open framework structure, a closed wall structure, or a combination of both types of structure. From an aesthetic point of view, an open framework structure has been found to be most desirable. Since the stand occupies a relatively large space, an open structure looks less intrusive and is more convenient and less expensive to manufacture. Furthermore, it is a lot easier to see what the label is on the cask if the stand has an open structure. This can be important when there are several casks with different contents being used on adjacent stands.

The open structure framework is conveniently constructed of rigid fabrication materials which can be tubular, rod-profile, square or rectangular section, and so on. The range of construction materials is practically limitless and include such materials as natural products, for instance cane, bamboo and timber; and man-made products such as plastics, composite materials and metals. By far the most preferred are the metals such as iron and steel, including stainless steel, copper and aluminium, and metal alloys such as brass and pewter. The particular material chosen will be based upon the requirements of the consumer. For a high quality finish, the stand will typically be manufactured from hand-forged iron rod which is powder coated for protection and aesthetic requirements. For an even more "up-market" version, the stand will be hand made from high quality stainless steel or brass rod. For the average consumer the stand will be manufactured from heavy gauge steel wire which is processed automatically with spot welded jointing. The resultant product can be zinc platted or dip painted on a continuous production line.

In constructing the stand from heavy gauge steel wire, the framework can conveniently comprise two substantially identical open structured side walls each formed from a continuous piece of steel wire, which are interconnected at an intermediate region by intermediate wire members having the additional function of providing a platform on which the cask rests. One or more extra wires can extend between the intermediate wire members themselves in order to provide further support for the cask, if deemed necessary; and one or more connecting wires can join the lower sections of the framework together to give added rigidity to the structure as a whole.

Preferably, each side wall framework is essentially triangular in side-elevation wherein one of the sides of the triangle forms the base. Most preferably, the triangle is a right-angle triangle wherein the perpendicular side of the triangle forms the rear portion of the stand and the hypotenuse, the front portion of the stand (by "front" it is intended to mean that portion which, in use, faces the user). Further, the hypotenuse may be splayed outwardly below the cask platform, when viewing the stand from the front. Such splaying will provide extra stability for the stand and will also contribute to the aesthetics of the stand.

When a triangular walled structure is adopted, a single connecting wire is sufficient to join the bottom portion of each triangle to one another. All wires, including the intermediate wires, the extra wire or wires joining the intermediate wires, and each side wall framework, are conveniently interconnected by spot-welding. The triangular walls are typically produced by cold bending in a continuous automatic production facility.

In one adaptation of the open structured framework which is specifically designed for use with wine or port casks, it is useful to include means for also holding stemmed wine or port glasses. To this end, a fixed or removable extension can be associated with the stand which projects outwardly from the stand and adjacent to one or both side walls thereof. The extension suitably comprises a pair of spaced arms which are projected horizontally and between which the stem of several glasses can be fitted at an opening between the ends of the arms. The spading between the arms is selected so that the plinth of the glasses cannot pass between the arms and are properly supported by the arms. Preferably, such an extension is located on each side of the stand and the extensions are interconnected by a tie piece. Suitably, the tie piece forms the region for attachment to the stand. Preferably, the tie piece is removable and is connectable to a member lying in the plane of the rear section of the stand. The member can conveniently be an upstanding peg onto which the tie piece is fitted and held in place by friction. To enable this, the tie piece can have a loop which fits over a peg having an outwardly and downwardly tapering end piece.

The restraining means of the cask stand are designed to give side support to the cask to prevent it from movement when in use. To this end, it is preferred that a snug fit is achieved between the cask and the stand. Preferably, the restraining means of the stand will extend at least about two thirds up the side walls of the cask to ensure adequate support is provided.

The stand thus described can be connected with one or more other stands in series so as to support several casks in line. This may be achieved, for instance, by the addition of extra connecting members which are welded or otherwise joined to the rear portion of the stands, and optionally to the base portions thereof.

The invention thus described addresses the problems associated with casks as previously mentioned, and provides the public with a useful choice.

DESCRIPTION OF PREFERRED EMBODIMENTS

Figure 2:
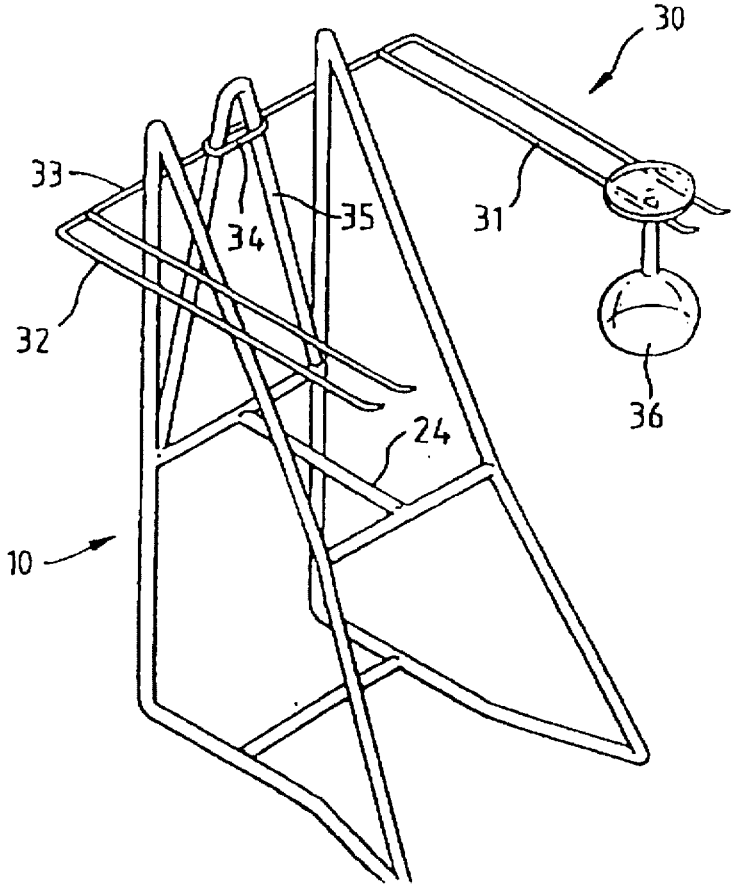

Preferred embodiments of the invention will now described with reference to the accompanying drawings, in which:

FIG. 1 is an isometric view of a stand according to the present invention, shown supporting a cask; and FIG. 2 is an isometric view of a modified stand including glass support means.

In both of the drawings, like reference numerals refer to like parts.

Referring firstly to FIG. 1, the stand 10 is designed to support a two litre wine cask 11. The stand is fabricated from 8 mm iron rod which is painted black. It comprises two mirror image vertically extending structures comprising triangular shaped side walls 12, 13 which are splayed outwardly at their lower front edges 14, 15 for extra stability. The side walls form right-angled triangles when viewed side-on, with perpendicular uprights 16, 17; horizontal support engaging members 18, 19; and hypotenuses 20, 21.

Each side wall is interconnected with the other by tie members 22, 23, 25. An additional connecting member, similar to connecting member 24 in FIG. 2, joins the tie members 22 and 23 to one another and provides a platform for the cask 11 to rest upon.

The wine cask 11 is snugly retained between the perpendicular uprights 16, 17 and the hypotenuses 20, 21 so that lateral movement of the cask relative to the stand is not possible.

It is apparent from the design that a wine glass can easily be located under the tap 26 of the cask for filling.

The FIG. 2 embodiment is basically the same as shown in FIG. 1 with the addition of glass support means 30. The glass support means comprises two pairs of rigid support arms 31, 32 arranged to be located on each side of the wine cask. The support arms are interconnected by an integral member 33 extending in the rear plane of the stand. The support arms and integral member are fabricated from 4 mm iron rod which is also painted black.

The support means 30 is removably fitted to the stand by virtue of an elongated loop 34 formed midway between the ends of the integral member 33. The loop is supported by a rear wall comprising an inverted V-shaped metal peg 35 which is welded to the stand at the intersection of the tie member 22 with the perpendicular uprights 16, 17.

The glass support means can support several glasses on each side of the stand. One glass is illustrated at 36.

Whilst the above has been given by way of illustrative example of the invention, many modifications and variations may be made thereto by persons skilled in the art without departing from the broad scope and ambit of the invention as herein set forth.

We claim:

1. A rigid, non-collapsible stand for a rectangular block-shaped cask having an outlet tap in a lower region, said stand comprising a platform for retaining the cask above a support surface by a sufficient amount to enable a receptacle to be placed under the outlet tap, and associated side walls to prevent lateral movement of the cask during manipulation of the outlet tap; wherein each side wall comprises a contiguous open-framed substantially identical vertically extending structure which is joined to the other side wall at an intermediate region by the platform, wherein a rear wall extends in the space between the vertically extending structures, above the intermediate region, which rear wall defines a surface against which a rear wall of the cask can be urged to restrain the cask from rearward movement; said stand including an extension for holding stemmed drinking glasses, said extension comprising two identical portions located on each side of the stand which are interconnected by an integral member fitted to the rear wall of the stand, said portions consisting of a pair of spaced arms which are projected horizontally and between which the stem of a drinking glass can be inserted and retained in an inverted position.

2. A stand for a cask as defined in claim 1, wherein the extension is removable from the rear wall of the stand.

3. A stand for a cask as defined in claim 1, wherein the rear wall of the stand comprises an inverted V-shaped element on which said integral member is fitted.

4. A stand for a rectangular block shaped cask having an outlet tap in a lower region, said stand comprising a platform for retaining the cask above a support surface by a sufficient amount to enable a receptacle to be placed under the outlet tap, and associated opposed side walls and an interconnecting rear wall projecting above the platform to prevent lateral movement of the cask during manipulation of the outlet tap; and including an extension for holding stemmed drinking glasses, said extension comprising two identical portions located on each side of the stand which are interconnected by an integral member fitted to the rear wall of the stand, said portions consisting of a pair of spaced arms which are projected horizontally and between which the stem of a drinking glass can be inserted and retained in an inverted position.

5. A stand for a cask as claimed in claim 4, wherein the extension is removable from the rear wall of the stand.

6. A stand for a cask as claimed in claim 4, wherein the rear wall of the stand comprises an inverted V-shaped element on which said integral member is fitted.

* * * * *